US010654548B2

(12) United States Patent
Hewitt et al.

(10) Patent No.: US 10,654,548 B2
(45) Date of Patent: May 19, 2020

(54) BOAT LIFT WITH ADJUSTABLE BUNKS

(71) Applicant: Hewitt Machine & MFG., Inc., Nicollet, MN (US)

(72) Inventors: Troy L. Hewitt, Nicollet, MN (US); Kent M. Evans, Nicollet, MN (US); James A. Lang, Courtland, MN (US)

(73) Assignee: HEWITT MACHINE & MFG., INC., Nicollet, MN (US)

( * ) Notice: Subject to any disclaimer, the term of this patent is extended or adjusted under 35 U.S.C. 154(b) by 0 days.

(21) Appl. No.: 15/698,161

(22) Filed: Sep. 7, 2017

(65) Prior Publication Data

US 2019/0071157 A1 Mar. 7, 2019

(51) Int. Cl.

| | |
|---|---|
| ***B63C 3/06*** | (2006.01) |
| *B63C 5/02* | (2006.01) |
| *B63C 3/12* | (2006.01) |

(52) U.S. Cl.

CPC ..... *B63C 3/06* (2013.01); *B63C 3/12* (2013.01); *B63C 2005/022* (2013.01)

(58) Field of Classification Search

CPC ..... B63C 3/06; B63C 3/08; F16B 7/04

See application file for complete search history.

(56) References Cited

U.S. PATENT DOCUMENTS

| | | | | |
|---|---|---|---|---|
| 779,600 | A * | 1/1905 | Hickler | B63C 5/04 405/7 |
| D484,086 | S * | 12/2003 | Davidson | D12/318 |
| D484,450 | S * | 12/2003 | Davidson | D12/317 |
| D487,423 | S * | 3/2004 | Davidson | D12/318 |
| 2004/0126185 | A1* | 7/2004 | Davidson | B63C 3/06 405/7 |
| 2007/0045984 | A1* | 3/2007 | Remedios | B60P 3/1066 280/414.1 |
| 2010/0189502 | A1* | 7/2010 | Basta | B63C 3/06 405/3 |

* cited by examiner

*Primary Examiner* — Tara Mayo-Pinnock

(74) *Attorney, Agent, or Firm* — Westman, Champlin & Koehler, P.A.

(57) ABSTRACT

A bunk for a boat lift includes a bottom portion pivotally configured to attach to one or more lifting beams of the boat lift. A top portion is positionably securable to the bottom portion wherein the top portion comprises includes a boat engaging surface having a first end and a second end wherein the first end is a first distance from a midplane of the top portion and the second end is a second distance from the midplane of the top portion. The top portion is positionable into a first position where the boat engaging surface is in a first position relative to the bottom portion and wherein the top portion is positionable into a second position by moving the top portion end for end relative to the bottom portion wherein boat engaging surface is a second position relative to the bottom portion.

19 Claims, 4 Drawing Sheets

BOAT LIFT WITH ADJUSTABLE BUNKS

BACKGROUND

The present disclosure relates to a boat lift. More particularly, the present disclosure relates to a boat lift having bunks configured to be spaced apart at adjustable distances and angles.

Typical boat lifts have at least two spaced apart bunks that are configured to engage and support a hull of the boat as the boat is lifted from a body of water. Typically, the bunks are configured to engage the hull substantially parallel to a midline of the boat. The forces imparted by gravity unto the hull as the boat is lifted are dispersed along the length of the bunks, such that the hull is not damaged during the lifting process.

However, the spacing between the hull engaging surfaces on the bunks is typically fixed. As such, while the engaging surface of the bunks may properly engage the hull of a certain size, the engaging surfaces of the bunks may not properly engage the hull of a smaller boat, a larger boat and/or a hull with a different configuration. Therefore, if a boat owner purchases a boat having a different size or hull design, the boat owner may also have to purchase a different lift to accommodate the new boat, even though the lift may have the necessary lifting capacity.

SUMMARY

This disclosure, in its various combinations, either in apparatus or method form, may also be characterized by the following listing of items:

An aspect of the present disclosure includes a lift for a boat having a base frame configured to be positioned in a body of water. A plurality of feet are movably secured to the base frame and configured to level the base frame. The lift includes a first plurality of spaced apart beams pivotally attached to the base frame and a second plurality of spaced apart beams pivotally attached to the base frame a distance from the first plurality of beams. A first bunk is pivotally attached to the first plurality of spaced apart beams wherein the first bunk includes a first boat engaging surface that is positionable to a selected angle to engage a hull of the boat. The lift includes a second bunk pivotally attached to the second plurality of spaced apart beams wherein the second bunk includes a second boat engaging surface that is positionable to a selected angle to engage a hull of the boat.

Another aspect of the present disclosure relates to a lift for a boat having a base frame configured to be positioned in a body of water, A plurality of feet are movably secured to the base frame and configured to level the base frame. The lift includes a first plurality of spaced apart beams pivotally attached to the base frame and a second plurality of spaced apart beams pivotally attached to the base frame a distance from the first plurality of beams. The lift includes a first bunk comprising a first bottom portion pivotally attached to the first plurality of spaced apart beams. The first bunk includes a first top portion positionably securable to the first bottom portion wherein the first top portion comprises a first boat engaging surface having a first end and a second end wherein the first end is a first distance from a first midplane and the second end is a second distance from the first midplane. The lift includes a second bunk comprising a second bottom portion pivotally attached to the second plurality of spaced apart beams. The second bunk includes a second top portion positionably securable to the second bottom portion wherein the second top portion comprises includes a second boat engaging surface having a first end and a second end wherein the first end is a first distance from a second midplane and the second end is a second distance from the second midplane. The first and second top portions are positionable into a first position where the first ends comprise outer edges of the boat engaging surface and are spaced apart a first distance and wherein the first and second top portions are positionable into a second position where the second ends comprise outer edges of the boat engaging surface and are spaced apart a second distance wherein the first distance is different from the second distance.

Another aspect of the present disclosure includes a bunk for a boat lift includes a bottom portion pivotally configured to attach to one or more lifting beams of the boat lift. A top portion is positionably securable to the bottom portion wherein the top portion comprises includes a boat engaging surface having a first end and a second end wherein the first end is a first distance from a midplane of the top portion and the second end is a second distance from the midplane of the top portion. The top portion is positionable into a first position where the boat engaging surface is in a first position relative to the bottom portion and wherein the top portion is positionable into a second position by moving the top portion end for end relative to the bottom portion wherein boat engaging surface is a second position relative to the bottom portion.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views. It is contemplated that all descriptions are applicable to like and analogous structures throughout the several embodiments.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art that fall within the scope of the principles of this disclosure.

The figures may not be drawn to scale. In particular, some features may be enlarged relative to other features for clarity. Moreover, where terms such as above, below, over, under, top, bottom, side, right, left, vertical, horizontal, etc., are used, it is to be understood that they are used only for ease of understanding the description. It is contemplated that structures may be oriented otherwise.

DETAILED DESCRIPTION

Figure 1:
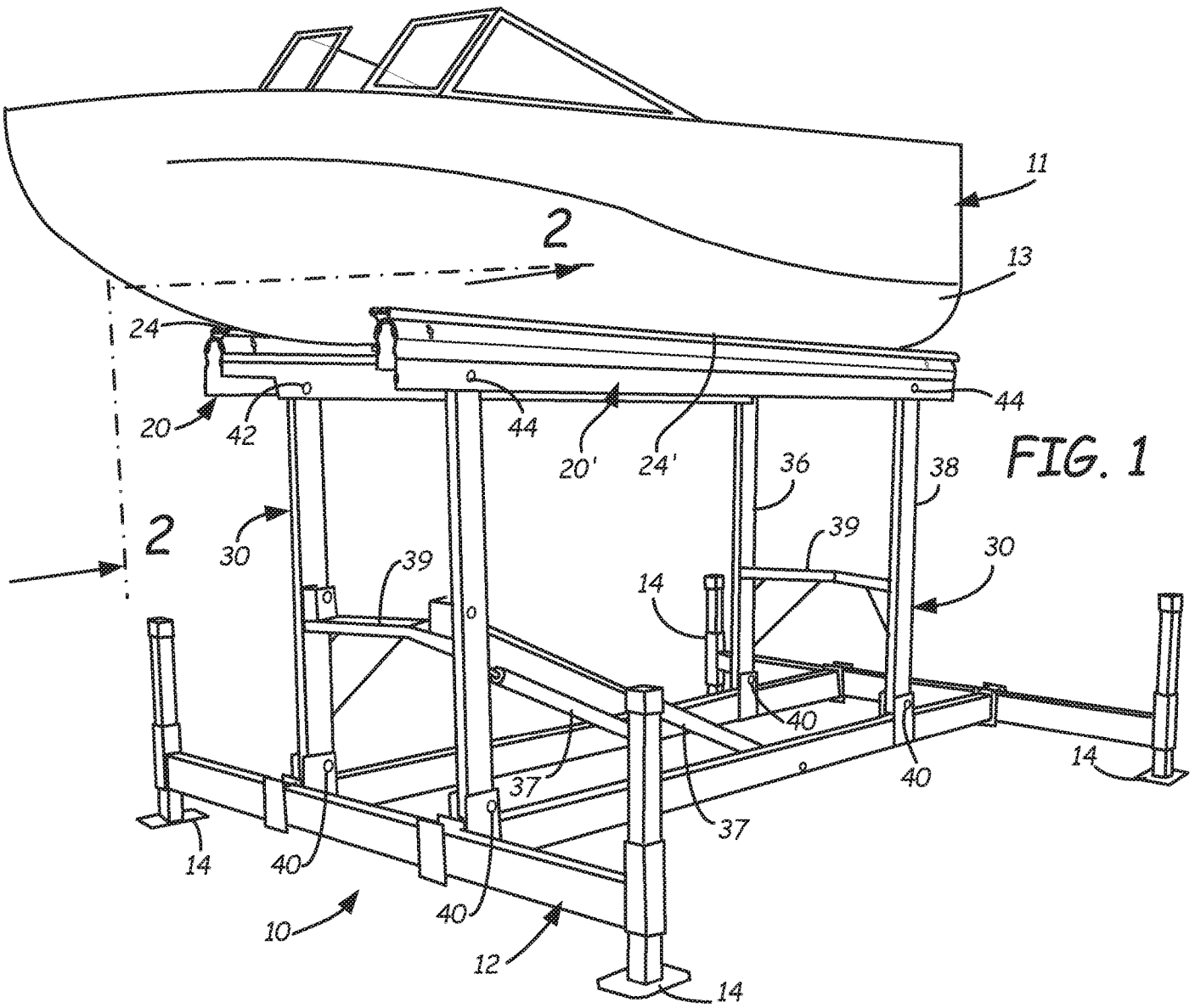
FIG. 1 is a perspective view of a boat raised on a boat lift using the bunks of the present disclosure.

A boat lift is generally illustrated in FIG. 1 at 10. The boat lift 10 includes a plurality of spaced apart bunks 20, 20' having hull engaging surfaces 24, 24', respectively. The spaced apart bunks 20, 20' have a multi-part construction such that a distance and/or angle between the hull engaging surfaces 24, 24' can be changed to provide a customized fit to a hull 13 of a boat 11. As the bunks are similarly constructed, similar features will be designated with a reference character for the bunk 20 and designated with the same reference character and the prime "'" designation for the bunk 20'.

The boat lift includes a base frame 12 configured to be placed into a body of water and engage a surface of the bed of the body of water. The base frame 12 typically has a plurality of feet 14 proximate corners of the base frame 12 where a position of each of the plurality of feet 14 is adjustable to compensate for a non-level surface of the bed of the body of water. When the plurality of feet 14 are properly positioned and secured to the base frame 12, the base frame 12 is substantially horizontal.

A plurality of spaced apart bunks 20, 20' are movably secured to the base frame 12 with a lifting frame 30. The lifting frame 30 typically includes first and second front beams 32, 34 and first and second back beams 36, 38. The beams 32, 34, 36 and 38 are each pivotally attached to the base frame 12 proximate a front end 16 and a back end 18 with pivot pins 40. The beams 32 and 36 are pivotally connected to the left bunk 20 with pivot pins 42 and the beams 34 and 38 are pivotally connected to the right bunk 20' with pivot pins 44.

The lifting frame 30 can include one or more braces 39 to provide structural integrity to the lift 10. However, the braces 39 are secured to the beams 32, 34, 36 and 38 such that the braces 39 do not interfere with the boat being steered onto the lift 10 and subsequently lifted from the body of water or the lift 10 being lowered to allow the boat to float on the water.

The pivotal attachment of the lifting frame 30 to the base frame 12 and the left and right bunks 20, 20' allows the bunks 20, 20' to be lowered below the surface of the body of water such that the boat 11 can float on the water and move away from the boat lift 10. The lifting frame 30 can also be raised once the boat 11 is located on the lift 10, such that the left and right bunks 20, 20' engage the hull 13 of the boat 11 and raise the boat above the surface of the water.

The lift 10 includes cylinders 37 to raise and lower the boat 11. The cylinders 37 can be hydraulic or pneumatic. However, other lifting mechanisms are within the scope of the present disclosure including, but not limited to, a winch and cable lifting mechanism.

The bunks in a typical boat lift are in a fixed position relative to each other. Therefore, while the boat lift may be rated for a certain sized boat, the bunks may not be compatible with the configuration of the boat hull, typically causing the owner of the boat to purchase a new lift.

Figure 2:
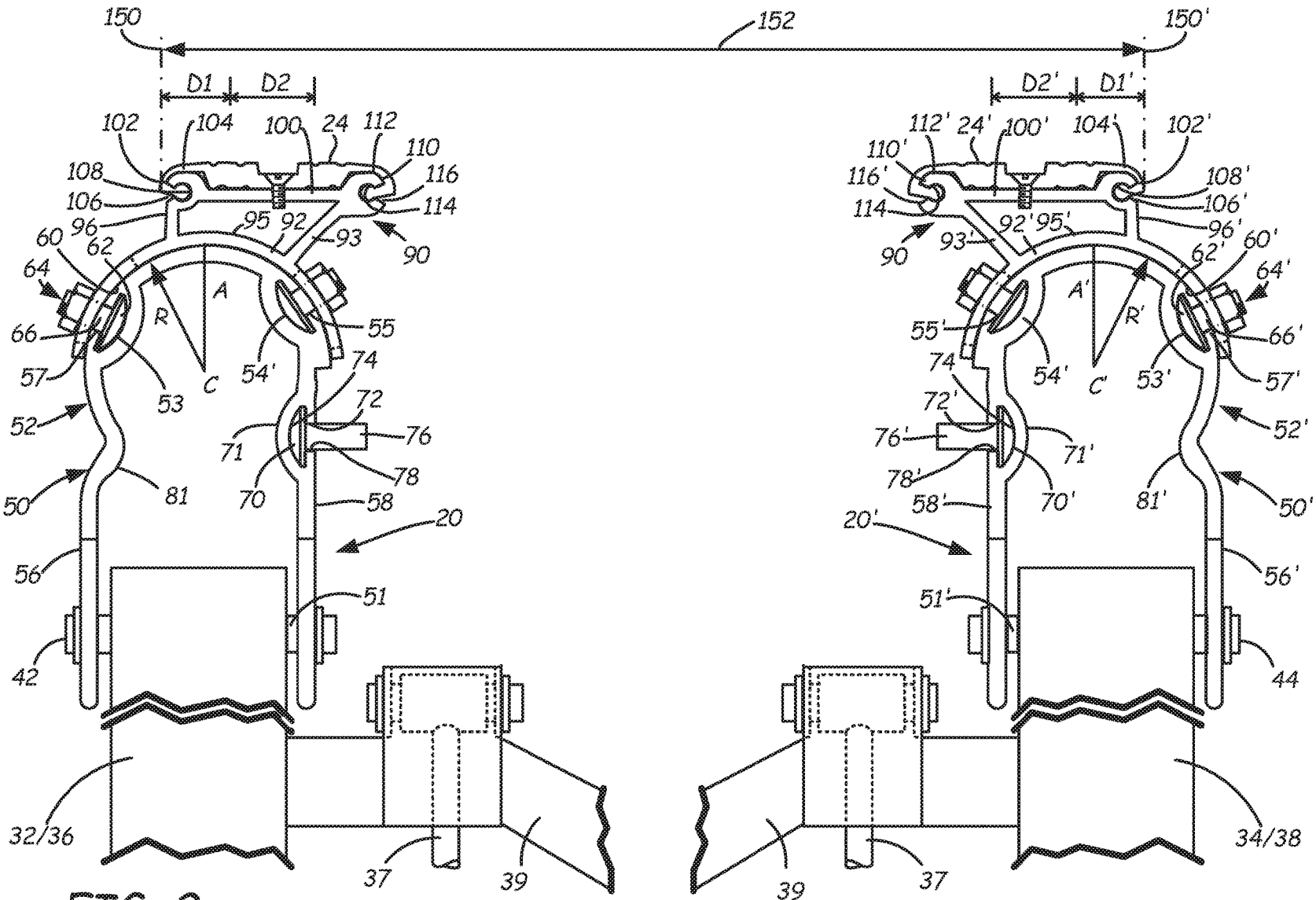
FIG. 2 is a schematic view of the bunks of a boat lift spaced apart a first distance.
Figure 3:
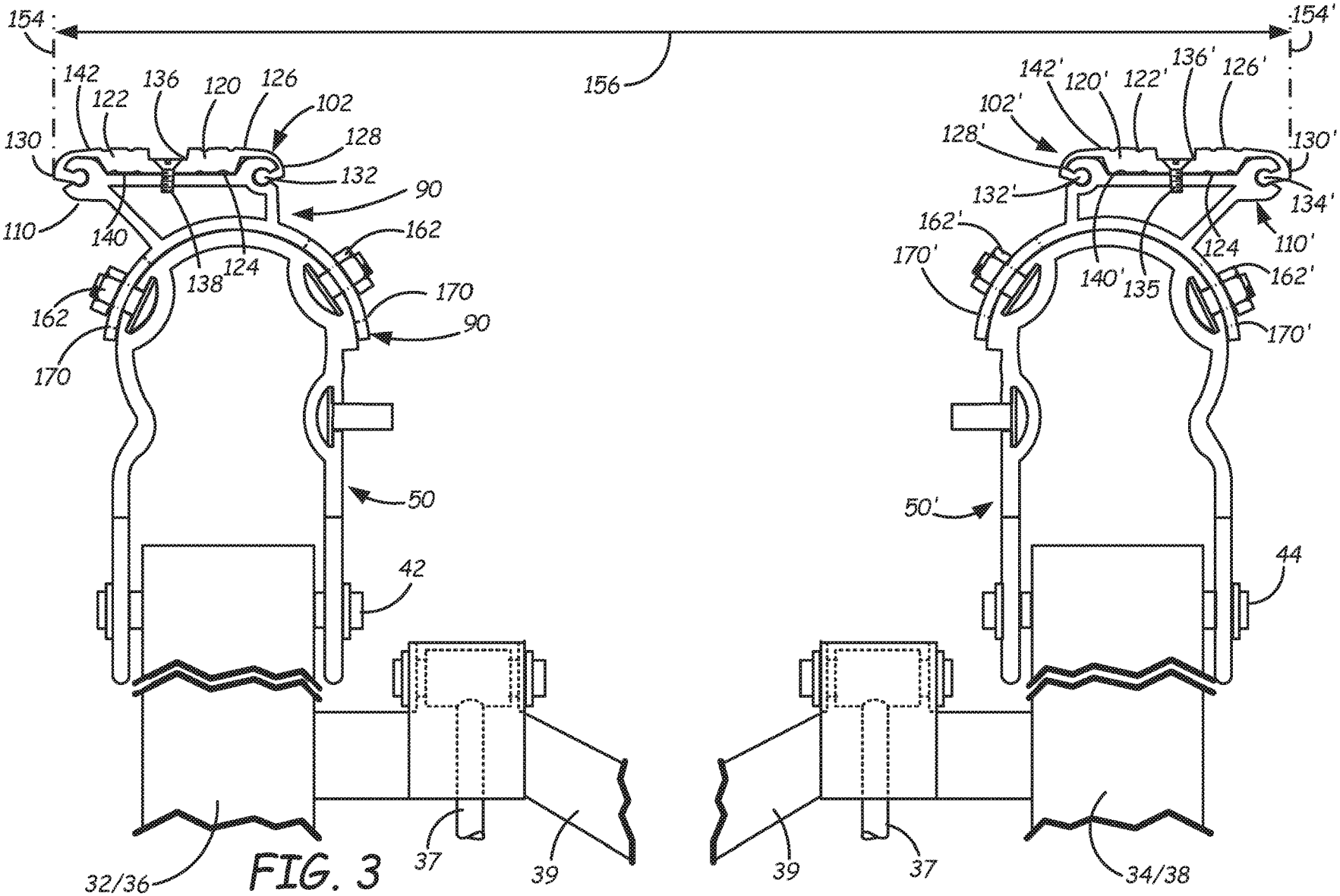
FIG. 3 is a schematic view of the bunks of the boat lift spaced apart a second distance that is longer than the first distance.

Referring to FIGS. 2 and 3, a multi-part bunk 20, 20' is illustrated that allows each bunk 20, 20' to be manipulated to increase or decrease a distance between hull engaging surfaces 24, 24' on the bunks 20, 20' respectively. Each of the multi-part bunks 20, 20' are similarly constructed such that one part of the multi-part bunk 20, 20' can be utilized with the other bunk 20, 20', which reduces the cost of manufacturing and ease of installation.

The bunk 20 includes a bottom portion 50 that pivotally attaches to the first front beam 32 and the first back beam 36 with the pivot pins 42 extending through apertures 51 in left and right wall portions 56 and 58. The bunk 20' includes a bottom portion 50' that pivotally attaches to the second front beam 34 and the second back beam 38 with the pivot pins 44 extending through apertures 51' in left and right wall portions 56' and 58'.

The wall portions 56, 56' and 58, 58' are connected with a substantially arcuate top portion 52, 52'. The arcuate top portion 52, 52' has an arcuate top surface 60, 60' having a substantially uniform radius R, R' that extends along a length L, L' of the bottom portion 50, 50'. The arcuate top portion 52, 52' includes left and right channels 53, 53' and 54, 54' offset a substantially equal radial distance relative to a line extending from a center-point C, C' to an apex A, A' of the arcuate top surface 60, 60' wherein the channels 53, 53' and 54, 54' have substantially the same configuration.

The channels 53, 53' and 54 extend the length of the bottom portion 50, 50'. The channels have an opening 57, 57' and 55, 55', respectively, providing access to the channels 53, 53' and 54, 54'. The channels 53, 53' and 54, 54' have a cross section that is defined by a chord of a circle. The channels 53, 53' and 54, 54' are configured to accept a head 62, 62' of a carriage bolt 64, 64' and a neck 66, 66' on the bolt has flat surfaces that engages surfaces defining the openings 57, 57' and 55, 55' to prevent rotation of the bolt within the channels 53, 53' and 54, 54'.

The wall portion 58, 58' includes a bottom channel 70, 70' with an opening 72, 72' similar to the other channels 53, 53' and 54, 54'. The bottom channel 70, 70' is configured to accept a head 74, 74' of a carriage bolt 76, 76', and a neck 78, 78' on the bolt 76, 76' has flat surfaces that engages surfaces defining the opening 72, 72'. The bottom channel 70, 70' is optional, but can be used to secure accessories to the bunk 20, 20', such a locating device that extends above the surface when the bunk 20, 20' is submerged.

A back surface 71, 71' of the bottom channel 70, 70' extends inwardly towards the wall portion 56, 56'. The wall portion 56, 56' includes an indention 80, 80' with a back surface 81, 81' that extends towards the wall portion 58, 58'. The back surface 81, 81' of the indention 80, 80' and the back surface 71, 71' of the channel 70, 70' constrict the space between the wall portions 56, 56' and 58, 58' and act as a stop by engaging the beams 32 and 36 and the beams 34 and 38 to prevent excessive movement of the bunks 20, 20', all respectively.

The bunk 20, 20' includes a top portion 90, 90' that has an arcuate base 92, 92' having an arcuate, bottom surface 94, 94' that has substantially the same radius as that of the radius R, R' of the top surface 60, 60' of the bottom portion 50, 50'. The bottom surface 94, 94' is configured to engage the top surface 60, 60' and rotatably slide about the top surface 60, 60' to change an angle of the hull engaging surface 24, 24'.

The top portion 90, 90' includes a substantially vertical member 96, 96' extending from an upper surface 95, 95' of the arcuate base 92, 92' that is attached a distance D1, D1' from an apex A, A' of the upper surface 95, 95'. The top portion 90, '90 includes a slanted member 98, 98' that is attached a distance D2, D2' from the apex A, A', where the distance D2, D2' is greater than the distance D1, D1'.

Top ends of the substantially vertical member 96, 96' and the slanted member 98, 98' are connected with a substantially horizontal member 100, 100'. A first junction 102, 102' of the substantially vertical member 96, 96' and the substantially horizontal member 100, 100' includes a raised arcuate portion 104, 104' having a substantially circular bore 106, 106' with a slot 108, 108' that intersects the bore 106, 106'. A second junction 110, 110' of the slanted member 98, 98' and the substantially horizontal member 100, 100' includes a raised arcuate portion 112, 112', that is substantially a mirror image of the first junction 102, 102', having a substantially circular bore 114, 114' with a slot 116, 116' that intersects the bore 114, 114'.

The bottom portion 50, 50' and the top portion 90, 90' are configured to be extruded to efficiently manufacture the portions. For example, the bottom portion 50, 50' and the top portion 90, 90' can be extruded to longer lengths and cut to a desired length of the bunk 20, 20'. Further, because the portions 50, 50' and 90, 90' are extruded, the portions 50, 50' and 90, 90' have a substantially consistent cross-section along the respective length. A non-limiting material of construction for the portions 50, 50' and 90, 90' is aluminum because it can be extruded, is lightweight, does not corrode in water and has the necessary structural strength to lift a boat.

The bunk 20, 20' includes an overlay member 120, 120' configured to cover surfaces on the top portion 90, 90' that could contact the hull 13 of the boat 11. The overlay member 120, 120' is typically a polymeric material that is sufficiently soft or malleable so to not harm the hull 11 when the bunk 20, 20' contacts the hull 13. However, other materials besides a polymeric material are within the scope of the present disclosure.

The overlay member 120, 120' includes a middle portion 122, 122' configured to be positioned between the first and second junctions 102, 102' and 110, 110', respectively. The middle portion 122, 122' has a thickness from a lower surface 124, 124' to an upper surface 126, 126' that extends above the upper most portion of the junctions 102, 102' and 110, 110'. Left and right engaging tabs 128, 128' and 130, 130' extend from the middle portion 122, 122' and wrap about the upper portions of the junctions 102, 102' and 110, 110'. The left and right engaging tabs 128, 128' and 130, 130' include rods 132, 132' and 134, 134' at distal ends thereof. The rods 132, 132' and 134, 134' are configured to be positioned in the bores 106, 106' and 114, 114', respectively, such that the engagement of the rods 132, 132' and 134, 134' within the bores 106, 106' and 114, 114', retain the overlay member 120, 120' to the top portion 90, 90'.

The upper surface 126, 126' includes a recessed groove 136, 136' that is located proximate a midplane of the middle portion 122, 122'. One or more rivets or crews 138, 138' are secured through an aperture in the middle portion 122, 122' and an aperture in the substantially horizontal member 100, 100' to retain the middle portion 122, 122' to the substantially horizontal member 100, 100'. The recessed groove 136, 136' prevents the rivet or screw head 132, 132' from contacting and damaging the hull 13.

The lower surface 124, 124' and the upper surface 126, 126' of the middle portion 122, 122' include a plurality of channels 140, 140' and 142, 142', respectively. The channels 140, 140' allows water to drain from between the top portion 90, 90' of the bunk 20, 20' and the overly member 120, 120'. The channels 142, 142' allow water to drain from between the hull 13 and the overlay member 120, 120'.

Referring to FIG. 2, the top portions 90, 90' are configured such the slanted members 98, 98' are positioned toward each other. With slanted members 98, 98' positioned toward each other, outer edges 150, 150' are located a distance apart as indicated by arrows 152. Referring to FIG. 3, the top portions 90, 90' are moved end for end and placed on the lower portions 50, 50' which results in outer edges 154, 154' being located a second distance apart as indicated by arrows 156. The distance indicated by arrows the 156 is larger than the distance indicated by the arrows 152.

Therefore, the bunks 20, 20' can be manipulated by the positioning of the top portion 90, 90' end for end on the bottom portion 50, 50' to adjust the spacing of the hull engaging surfaces 24, 24' on the boat lift 10. The adjustability of the top portions 90, 90' on the lower portions 50, 50' allows the same lift 10 better accommodate a variety of hull design.

The top portion 90, 90' is secured to the bottom portion 50, 50' by position slots 157, 157' in the top portion 90, 90' about a threaded end 67, 67' of the carriage bolt 64, 64'. The top portion 90, 90' includes at least two sets of slots 150, 150' so that the top portion 90, 90' is secured to the bottom portion 50, 50' along the length of the bunk 20, 20'. Nuts 162, 162' are then threadably secured to the threaded end 67, 67' of the bolts 64, 64' to frictionally secure the top portion 90, 90' to the bottom portion 50, 50'.

Figure 4:
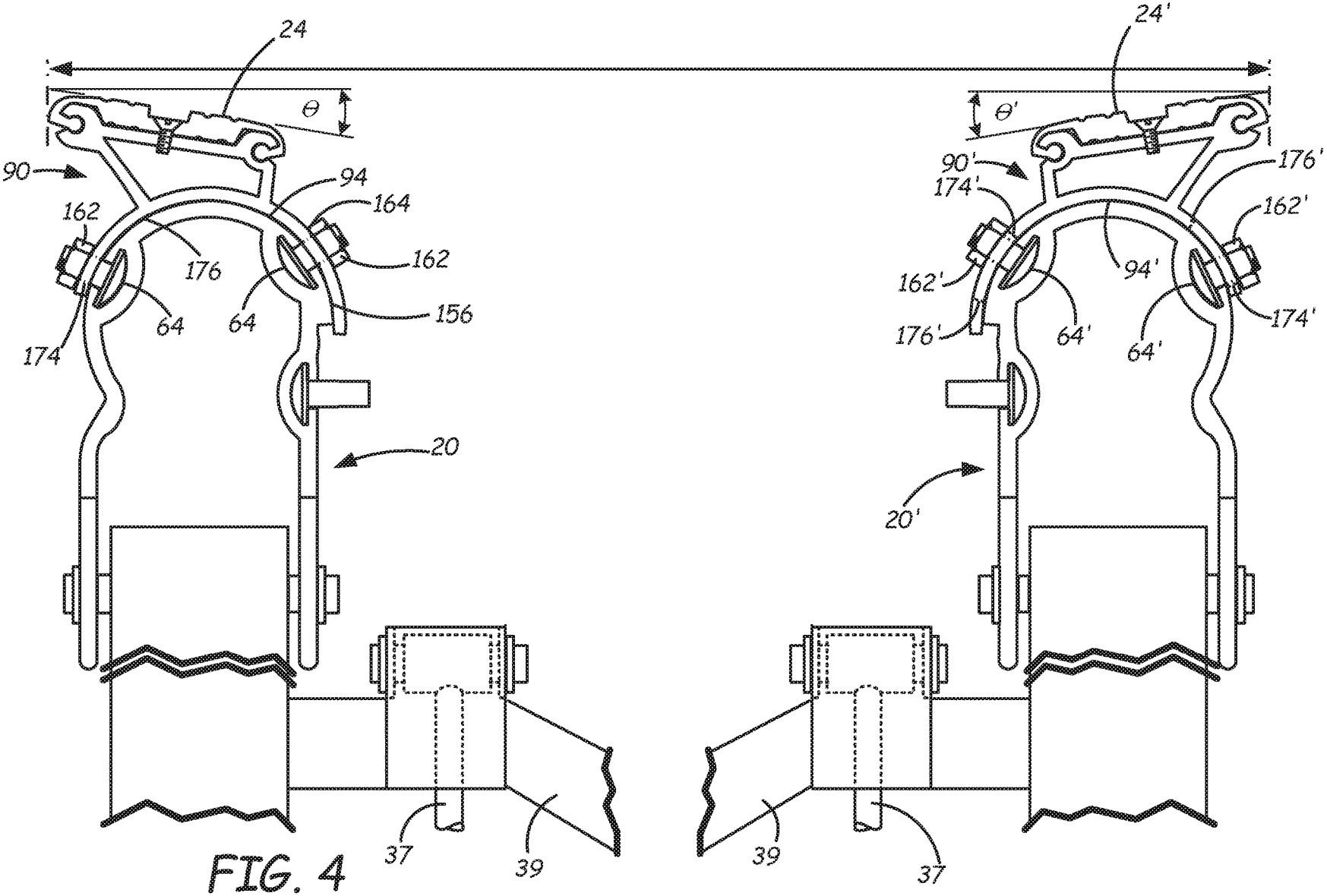
FIG. 4 is a schematic view of a bunk with a hull engaging surface positioned at an angle from horizontal.

As illustrated in FIGS. 2 and 3 the hull engaging surface 24, 24' is substantially horizontal. However, referring to FIG. 4, the bunk engaging surface 24, 24' can be manipulated by loosening the nuts 162, 162' on the bolts 64, 64' such that arcuate bottom surface 94, 94' of the top portion 90, 90' can be moved over the arcuate top surface 60, 60' of the bottom portion 50, 50'. As the top portion 90, 90' is moved relative to the bottom portion 50, 50', the hull engaging surfaces 24, 24' are positioned at a mirror image angles θ, θ' to conform to an angled surface of a hull. With the hull engaging surface 24, 24' at the selected angle θ, θ', the nuts 162, 162' are tightened the bolts 64, 64' to retain the top portion 90, 90' in the selected orientation on the bottom portion 50, 50'.

Lengths of the slots 157, 157' limit the range of movement of the top portion 90, 90' relative to the bottom portion 50, 50'. The top portion 90, 90' relative to the bottom portion 50, 50' from a first end 174, 174' to a second end 176, 176' of the slot 157, 157' wherein contact with the bolt 64, 64' prevents further rotation.

Although the subject of this disclosure has been described with reference to several embodiments, workers skilled in the art will recognize that changes may be made in form and detail without departing from the scope of the disclosure. In addition, any feature disclosed with respect to one embodiment may be incorporated in another embodiment, and vice-versa.

The invention claimed is:

1. A lift for a boat comprising:

a base frame configured to be positioned in a body of water;

a plurality of feet movably secured to the base frame and configured to level the base frame;

a first plurality of spaced apart beams pivotally attached to the base frame;

a second plurality of spaced apart beams pivotally attached to the base frame a distance from the first plurality of beams;

a first bunk pivotally attached to the first plurality of spaced apart beams wherein the first bunk includes a first boat engaging surface; and a second bunk pivotally attached to the second plurality of spaced apart beams wherein the second bunk includes a second boat engaging surface that is positionable to a selected angle to engage a hull of the boat;

wherein each of the first and second bunks comprises:

a bottom portion attached to the respective plurality of spaced apart beams, the bottom portion having an arcuate top surface;

a top portion having the boat engaging surface, the top portion comprising an arcuate bottom surface that engages and slidably rotates about the arcuate top surface such that the first and second boat engaging surfaces are positionable to selected angles to engage a hull of the boat; and a securing mechanism configured to engage the bottom portion and the top portion and fix a position of the top portion relative to the bottom portion such that the boat engaging surface is retained at the selected angle.

2. The lift of claim 1 wherein each of the first and second bunks comprises:

the bottom portion is pivotally attached to the respective plurality of spaced apart beams, the bottom portion having an arcuate top surface.

3. The lift of claim 1 and wherein the securing mechanism comprises:

at least one bolt retained to the bottom portion;

at least one slot in the top portion configured to accept the bolt, wherein a length of the at least one slot allows the top portion to rotatable slide over the bottom portion such that the boat engaging surfaces are at the selected angles; and a nut configured to engage the bolt and frictionally secure the top portion to the bottom portion with the hull engaging surface at the selected angle.

4. The lift of claim 1 and wherein the boat engaging surface has a first edge and a second edge, wherein the first edge is a first distance from an apex of the arcuate bottom surface and the second edge is a second distance from an apex of the arcuate bottom surface wherein the first distance and the second distance are different, wherein when the top portions are in a first position the boat engaging surfaces are a first distance apart and wherein when the top portions are in a second position that is end for end relative to the first position, the boat engaging surfaces are a second distance apart wherein the first distance and the second distance are different.

5. A lift for a boat comprising:

a base frame configured to be positioned in a body of water;

a plurality of feet movably secured to the base frame and configured to level the base frame;

a first plurality of spaced apart beams pivotally attached to the base frame;

a second plurality of spaced apart beams pivotally attached to the base frame a distance from the first plurality of beams;

a first bunk comprising:

a first bottom portion pivotally attached to the first plurality of spaced apart beams; and a first top portion having a first end and a second end, the first top portion positionably securable to the first bottom portion wherein the first top portion comprises a first boat engaging surface having a first edge and a second edge wherein the first edge is a first length from a first midplane and the second edge is a second length from the first midplane wherein the first length is different from the second length; and a second bunk comprising:

a second bottom portion pivotally attached to the second plurality of spaced apart beams; and a second top portion having a first end and a second end, the second top portion positionably securable to the second bottom portion wherein the second top portion comprises a second boat engaging surface having a first edge and a second edge wherein the first edge is a first length from a second midplane and the second edge is a second length from the second midplane, wherein the first length is different from the second length, wherein the first and second top portions are positionable into a first position where the first edges comprise outer edges of the boat engaging surface and are spaced apart a first distance and wherein the first and second top portions are positionable into a second position, wherein the second position is end for end from the first position, where the second edges comprise outer edges of the boat engaging surface and are spaced apart a second distance wherein the first distance is different from the second distance.

6. The lift of claim 5 and wherein the first and second bottom portions are mirror images when attached to the respective beams, wherein the first and second bottom portions each comprises:

spaced apart lower portions configured to be positioned on opposite sides of the respective beam;

an arcuate portion attaching the spaced apart lower portions, wherein the arcuate portion has a convex upper surface with an apex and first and second channels located substantially a same distance from the apex wherein the first and second channels are configured to accept one or more bolts and prevent rotation therein.

7. The lift of claim 6 and wherein the first and second top portions are mirror images when attached to the first and second bottom portions, respectively, where the first and second top portions each comprises:

a base portion having a bottom concave surface configured to engage the convex upper surface, the concave surface having an apex wherein the base portion comprises a plurality of spaced apart slots, wherein each slot is configured to be positioned about one of the one or more bolts; and a support structure attached to the base portion and having the boating engaging surfaces wherein when the first and second top portions are moved end for end on the first and second bottom portions to position the boat engaging surfaces in the first and second positions.

8. The lift of claim 7 and further comprising the boat engaging surfaces being positioned at an angle to horizontal by slidably rotating the concave surface of the base portion of the top portion about the convex surface of the bottom portion.

9. The lift of claim 8 where a length of the plurality of the spaced apart slots limits the rotational position of the top portion relative to the bottom portion.

10. The lift of claim 6 and wherein the arcuate portion comprises:

spaced apart channels along a length of the bottom portion wherein the spaced apart channels are substantially equidistant from the apex wherein the space apart channels are configured to accept a head of a bolt and prevent the bolt from rotating therein.

11. The lift of claim 10 and wherein the bolt comprises carriage bolts and wherein the spaced apart channels are configured to accept and prevent rotation of the carriage bolts.

12. The lift of claim 6 and wherein the spaced apart lower portions each comprises an indented surface that constricts a distance between the spaced apart lower portions and is configured to engage the beams to prevent further pivotal movement therebetween.

13. The lift of claim 6 and wherein one of the spaced apart lower portions comprises a lower channel configured to retain an accessory thereto.

14. A bunk for a boat lift comprising:

a bottom portion pivotally configured to attach to one or more lifting beams of the boat lift; and a top portion having a first end and a second end, the top portion positionably securable to the bottom portion wherein the top portion comprises a boat engaging surface having a first edge and a second edge wherein the first edge is a first distance from a midplane of the top portion and the second is a second distance from the midplane of the top portion wherein the top portion is positionable into a first position where the boat engaging surface is in a first position relative to the bottom portion and wherein the top portion is positionable into a second position by moving the top portion end for end relative to the bottom portion wherein boat engaging surface is a second position relative to the bottom portion.

15. The bunk of claim 14 and wherein the bottom portion comprises:

spaced apart lower portions configured to be positioned on opposite sides of the lifting beams;

an arcuate portion attaching the spaced apart lower portions, wherein the arcuate portion has a convex outer surface with an apex and first and second channels located substantially a same distance from the apex wherein the first and second channels are configured to accept one or more bolts and prevent rotation therein.

16. The bunk of claim 15 and wherein the top portion comprises:

a base portion having a bottom concave surface configured to engage the convex upper surface, the concave surface having an apex wherein the base portion comprises a plurality of spaced apart slots, wherein each slot is configured to be positioned about one of the one or more bolts; and a support structure attached to the base portion and having the boating engaging surfaces wherein when top portion is moved end for end on the bottom portion to position the boat engaging surface in the first and second positions.

17. The bunk of claim 16 and further comprising the boat engaging surface being positioned at an angle to horizontal by slidably rotating the concave surface of the base portion of the top portion about the convex surface of the bottom portion.

18. The bunk of claim 17 where a length of the plurality of the spaced apart slots limits the rotational position of the top portion relative to the bottom portion.

19. The bunk of claim 15 and wherein the arcuate portion comprises:

spaced apart channels along a length of the bottom portion wherein the spaced apart channels are substantially equidistant from the apex wherein the space apart channels are configured to accept a head of a bolt and prevent the bolt from rotating therein.

* * * * *